United States Patent [19]

Krillic et al.

[11] 3,948,784

[45] Apr. 6, 1976

[54] TREATMENT OF INDUSTRIAL GRINDING AND CUTTING LUBRICANTS

[75] Inventors: Hobart M. Krillic, South Holland; Edward F. Leary, Western Springs, both of Ill.

[73] Assignee: Nalco Chemical Company, Oak Brook, Ill.

[22] Filed: Mar. 24, 1975

[21] Appl. No.: 561,738

[52] U.S. Cl. ..... 252/26; 72/42; 252/25; 252/28; 252/49.3; 252/49.5; 252/52 R; 252/52 A

[51] Int. Cl.[2]. C10M 1/10; C10M 3/02; C10M 3/04; C10M 5/04

[58] Field of Search ..... 72/42; 252/49.3, 49.5, 252/51, 52 A, 52 R, 25, 26, 28

[56] References Cited

UNITED STATES PATENTS

| | | | |
|---|---|---|---|
| 3,501,404 | 3/1970 | Klaiber et al. | 252/49.5 |
| 3,645,903 | 2/1972 | Stram et al. | 252/49.3 |
| 3,788,988 | 1/1974 | Dubourg | 252/49.5 |

*Primary Examiner*—Delbert E. Gantz
*Assistant Examiner*—I. Vaughn
*Attorney, Agent, or Firm*—John G. Premo; Barry W. Sufrin; Robert A. Miller

[57] ABSTRACT

A method of clarifying water-soluble lubricants used in industrial grinding and cutting using cationic polyelectrolytes.

14 Claims, No Drawings

TREATMENT OF INDUSTRIAL GRINDING AND CUTTING LUBRICANTS

BACKGROUND OF THE INVENTION

Modern industrial manufacturing processes often involve the utilization of emulsifiable oil or non-petroleum water-soluble formulations in cutting and grinding operations. The emulsifiable oil and non-petroleum water-soluble formulations include lubricants and cutting fluids and are used, for example, in the grinding and smoothing of edges of manufactured glass products and in the machining of cast iron objects. The emulsifiable oil formulations are commonly referred to as "water-soluble oils" in the parlance of the industry. Due to their similarity of function, we will refer to the lubricants and the cutting fluids collectively by the term "water-soluble lubricants."

Water-soluble lubricants commonly contain a number of components which help reduce heat generation thereby extending tool life and improving surface finish. These lubricants also tend to lubricate and reduce or prevent corrosion in moving parts located near to the cutting or grinding tool. A typical water-soluble lubricant used in glass grinding operations might contain: (a) triethanolamine salt of an acid phosphate ester to reduce heat caused by extreme pressure at the cutting surfaces, and to reduce corrosion; and (b) water to cool the cutting surfaces. A typical water-soluble lubricant used in the machining of cast iron might contain: (a) triethanolamine caprylate to reduce corrosion and enhance lubricity; (b) sodium nitrite to prevent corrosion; (c) polyalkylene glycol as a lubricating and anti-wear agent; and (d) water to cool the cutting surfaces.

Due to economic and other considerations, it is desirable to reuse water-soluble lubricants. Each time the lubricants are used, particles of the material being ground or cut become suspended in the lubricant and impair its further usefulness. In glass grinding operations, silica particles and metallic oxides become suspended in the water-soluble lubricant; in cast iron machining processes, iron and graphitic particles become suspended in the water-soluble lubricant. The suspended particles tend to clog grinding wheels and to cause dulling of cutters, requiring premature tool replacement and impairing the quality of the surface finishes. Also, the suspended particles may interfere with the operation of pumping and circulating apparatus.

SUMMARY OF THE INVENTION

We have discovered a method of reducing the above described drawbacks to the reuse of water-soluble lubricants. In particular, we have found that the addition of certain cationic polyelectrolytes to the water-solubles will result in flocculation and settling of suspended particles produced during industrial cutting and grinding operations.

Typical particles effectively treated by the method of our invention are composed of silica, metallic oxides, iron and graphite. Due to the wide variation and the physical characteristics (e.g., specific gravity and charge-carrying ability) present in these different types of particles, varying amounts of the cationic polyelectrolyte must be employed. It has been found that at least 0.5 ppm by weight of the cationic electrolyte are required in the treatment of water-soluble lubricants containing such suspended particles. A useful range of cationic polyelectrolyte concentration for the treatment of water-soluble lubricants containing silica particles is from 8–250 ppm by weight. A preferred cationic electrolyte concentration in the treatment of water-soluble lubricants containing silica particles is from 25–150 ppm by weight. In the treatment of water-soluble lubricants containing particles composed of metals, metallic oxides and carbon, however, a useful concentration of the polyelectrolyte may run as low as 0.5 ppm and as high as 200 ppm. In this latter application we have found that 0.9–1.8 ppm of the polyelectrolyte are especially effective.

The method of our invention may be carried out by:

A. adding a cationic polyelectrolyte, as described herein, to the water-soluble lubricant being treated;

B. dispersing this cationic polyelectrolyte and allowing the mixture to stand at least 2 minutes to allow flocculation and settling to occur; and then, C. separating the water-soluble lubricant from the settled particles.

Among the cationic polyelectrolytes effective as flocculating agents in our invention are the polymeric polyamines. Generally these polymers have molecular weights in excess of 1,000 and preferably in excess of 2,000. The most preferred polymers of this type have molecular weights in the range of 2,000–50,000. Such polymeric polyamines may be formed by a wide variety of reactions such as by the reaction of alkylene polyamines and difunctional alkyl materials.

A successful class of polyamine polymers are the condensation polymers of alkylene polyamines and halohydrins. A polyamine condensation polymer of this type may be generically defined as an aqueous solution containing 5–40% by weight of a high molecular weight epihalohydrin-alkylene polyamine condensation copolymer, said aqueous solution being further characterized as having a viscosity of at least 10 cps., when measured as an aqueous solution containing 20% by weight of said condensation copolymer at 75°F.

Preferred materials falling within this class have a viscosity of at least 50 cps. when measured as just described. The upper limit of the viscosity is anything short of gel formation. Most preferred products have viscosities of from about 50 to about 800 cps. In order to form these preferred polymers, it is only necessary to polymerize the epihalohydrin and alkylene polyamine at temperatures ranging from about 105°F. to 185°F. at a mole ratio of epihalohydrin to alkylene polyamine falling within the range of 1.4:1 to 2.2:1. For best results the polymerization reaction is generally carried out in dilute aqueous solutions at reactant concentrations ranging from about 10 to about 30% by weight.

As mentioned above, the 2 classes of monomeric reactants involved in the condensation polymerization are epihalohydrins and alkylene polyamines. The epihalohydrins that may be employed include such materials as epichlorohydrin, epibromohydrin and epiiodohydrin. Of these, the most preferred, due to cost and ready availability, is epichlorohydrin.

The alkylene polyamines which are reacted with the polyfunctional halohydrin for the purpose of the invention are well-known compounds having the general formula:

$$H_2N(C_nH_{2n}NH)_xH$$

where $n$ is an integer from 1 to 4 and $x$ is 1 or more. Preferably, $n$ is 2 and $x$ ranges from 1 to 5 to give the preferred polyethylene polyamine class. Examples of alkylene polyamines useful in the invention are the alkylene diamines, such as ethylene-diamine, 1,2-propylene diamine, 1,3-propylene diamine and the polyalkylene polyamines, such as, for example, diethylene triamine, triethylene tetramine, tetraethylene pentamine, pentaethylene hexamine, dipropylene triamine, and the similar polypropylene polyamines and polybutylene polyamines. Mixtures of any of the above may also be used and oftentimes commercial sources of these compounds contain 2 or more of any of the above alkylene polyamines. Some commercial amine products may contain mixtures of as many as 5 separate compounds.

A preferred species of polyamines falling within the above class is formed by reaction of an alkylene dihalide and a water-soluble basic nitrogen compound. Preferred water-soluble basic nitrogen compounds include ammonia, ethylene diamine, diethylene triamine, tetraethylene pentamine and triethylene pentamine. Of these, the most preferable due to excellent reactivity, low cost and availability is ammonia. The alkylene dihalide reactant may be chosen from a wide variety of difunctional organics including ethylene dichloride and 1,2-propylene dichloride. Of these, the most preferred is ethylene dichloride. One excellent cationic polymer for use as a flocculating agent in our invention is formed by the reaction of ammonia and ethylene dichloride under superatmospheric pressures and with heating, as disclosed in U.S. Pat. No. 3,751,474.

In a preferred embodiment of our invention, the polyamines just described are converted to polyquaternary compounds. This conversion may be accomplished by the use of such agents as methyl chloride, ethyl chloride, propyl chloride and others. We have found an especially successful polyquaternary flocculating agent for treating particles composed of metals, metallic oxides, silica and carbon (which we refer to collectively as inorganics) to be made up of 24% ethylene dichloride, 16% methyl chloride and 6% ammonia brought to volume with 12 molar caustic.

Another class of cationic polyelectrolytes effective in our invention are the high molecular weight substantially linear polyquaternary compounds made from secondary amines and difunctional epoxides. The secondary amines used in the formation of these compounds preferably contain between 2 and 8 carbon atoms. Useful secondary amines include dimethylamine, ethylmethylamine, diethylamine, propylmethylamine, propylethylamine, dipropylamine, dibutylamine, propylbutylamine, ethylbutylamine, methylbutylamine, pentylmethylamine, pentylethylamine and pentylpropylamine. In addition, other amines may be used, though it is important that the amine be relatively short chained due to reactive concentrations and as well as solubility in water.

While it is not absolutely necessary, the secondary amine chosen should be water-soluble and should react easily with a difunctional epoxide compound. With some of the amines listed above and most notably with dimethylamine, high concentrations such as those listed above may be maintained only by the use of pressurized equipment since these amines are gases at room temperature.

The difunctional epoxide compounds used in making these polyquaternary polymers must contain an epoxide group which is readily served in a condensation polymerizaiton reaction and an additional reactive functional group such as a halide. These compounds should not be over 6 carbon atoms in length and should not contain more than 2 reactive sites due to the possibility of crosslinking which is undesirable during the course of the reaction. Examples of compounds satisfying these requirements include epichlorohydrin, epibromohydrin and epiiodohydrin.

EXAMPLES

EXAMPLE 1

A sample of a water-soluble lubricant composed of triethanolamine caprylate, a triethanolamine salt of an acid phosphate ester, and water was obtained. The lubricant has been used in an industrial glass grinding operation and contained approximately 1.1% by volume glass fines. 100 ml. portions were treated, drop wise, with a cationic polyelectrolyte formed by the reaction of approximately 25% ethylene dichloride, 15% methyl chloride and 6% ammonia, in sufficient dilute caustic to bring the reaction mixture to 100%.

The test data appear below in Table I. The varying polyelectrolyte concentrations indicated were obtained by diluting with water.

TABLE I - EXAMPLE 1

| RUN | LUBRICANT VOLUME (ML.) | DROPS OF POLYELECTROLYTE | CONCENTRATION OF POLYELECTROLYTE USED (PERCENTAGE BY WEIGHT) | CONCENTRATION OF POLYELECTROLYTE IN MIXTURE (PPM) | RESULTS |
|---|---|---|---|---|---|
| 1 | 100 | 1 | 46 | 40 | optimum |
| 2 | 100 | 2 | 46 | 81 | optimum |
| 3 | 100 | 3 | 46 | 121 | optimum |
| 4 | 100 | 4 | 46 | 162 | good |
| 5 | 100 | 5 | 46 | 202 | good |
| 6 | 100 | 6 | 46 | 243 | limited flocculation |
| 7 | 100 | 7 | 46 | 283 | limited flocculation |
| 8 | 100 | 8 | 46 | 324 | no flocculation |
| 9 | 100 | 1 | 23 | 20 | good |
| 10 | 100 | 2 | 23 | 40 | optimum |
| 11 | 100 | 3 | 23 | 61 | optimum |
| 12 | 100 | 4 | 23 | 81 | optimum |
| 13 | 100 | 5 | 23 | 101 | optimum |
| 14 | 100 | 6 | 23 | 121 | optimum |
| 15 | 100 | 1 | 11.5 | 10 | good |
| 16 | 100 | 2 | 11.5 | 20 | good |
| 17 | 100 | 3 | 11.5 | 30 | good |
| 18 | 100 | 4 | 11.5 | 40 | optimum |
| 19 | 100 | 5 | 11.5 | 51 | optimum |
| 20 | 100 | 6 | 11.5 | 61 | optimum |
| 21 | 100 | 1 | 5.8 | 5 | limited flocculation |

TABLE I - EXAMPLE 1-continued

| RUN | LUBRICANT VOLUME (ML.) | DROPS OF POLYELECTROLYTE | CONCENTRATION OF POLYELECTROLYTE USED (PERCENTAGE BY WEIGHT) | CONCENTRATION OF POLYELECTROLYTE IN MIXTURE (PPM) | RESULTS |
|---|---|---|---|---|---|
| 22 | 100 | 1 | 2.9 | 2.5 | limited flocculation |
| 23 | 100 | 1 | 1.4 | 1.3 | limited flocculation |
| 24 | 100 | 1 | 0.7 | 0.6 | limited flocculation |

EXAMPLE 2

Another sample of water-soluble lubricant used in a glass grinding operation was obtained and treated as described above. The composition of the lubricant and of the polyelectrolyte was the same as in Example 1.

Results of the various experimental runs are indicated in Table II. It should be noted that the result in Run 1 is inconsistent with the overall results (Example 1 and Example 2) and is probably due to experimental error.

TABLE II - EXAMPLE 2

| RUN | LUBRICANT VOLUME (ML.) | DROPS OF POLYELECTROLYTE | CONCENTRATION OF POLYELECTROLYTE USED (PERCENTAGE BY WEIGHT) | CONCENTRATION OF POLYELECTROLYTE IN MIXTURE (PPM) | RESULTS |
|---|---|---|---|---|---|
| 1 | 100 | 3 | 46 | 121 | 5 min. - no floc formation |
| 2 | 50 | 1 | 46 | 81 | 2 min. - flocs begin to form |
| 3 | 25 | 1 | 11.5 | 40 | slow floc formation |
| 4 | 25 | 2 | 11.5 | 81 | flocs form |
| 5 | 25 | 3 | 11.5 | 121 | 15–20 seconds - flocs form and settle |
| 6 | 25 | 4 | 11.5 | 162 | flocs form |
| 7 | 25 | 5 | 11.5 | 202 | flocs form |
| 8 | 25 | 6 | 11.5 | 243 | slow floc formation |

EXAMPLE 3

A sample of a water-soluble lubricant composed of triethanolamine caprylate, sodium nitrite, polyalkylene glycol and water was obtained for testing. The lubricant had been used in a cast iron grinding operation and contained particles of iron and graphite. Samples of the lubricant were treated with the same polyelectrolyte employed in the above examples.

0.5, 1, 2, 4 and 8 ppm of a 4.6% by weight aqueous solution of the polyelectrolyte were added to 5 ml. portions of the lubricant. After 1–2 minutes, the suspended matter began to precipitate. The range of 0.9–1.8 ppm by weight of the polyelectrolyte resulted in the most rapid settling.

0.5, 1, 2, 4 and 8 ppm of a 7% by weight aqueous solution of the polyelectrolyte were added to 5 ml. portions of the lubricant. Once again, the suspended matter fell, though at a slower rate than obtained above. The range of 0.9–1.8 ppm by weight of the polyelectrolyte was again optimal.

0.5, 1, 2, 4 and 8 ppm of 11.5% aqueous solution of the polyelectrolyte were added to 5 ml. portions of the lubricant. The range of 0.9–1.8 ppm by weight of the polyelectrolyte was again optimal. The suspended matter fell, but at a rate slower than experienced in the first two series of tests; 0.9–1.8 ppm by weight of the polyelectrolyte was most effective.

In evaluating all 3 series of tests after 2 hours of settling, the first series (addition of 4.6% polyelectrolyte) was the best. In all cases, after 2 hours of settling 0.5–0.9 ppm of the polyelectrolyte gave results as good as 0.9–1.8 ppm.

EXAMPLE 4

3,000 gallons of a water-soluble lubricant of the same composition as described in Example 3 were treated. Once again the lubricant contained particles of iron and graphite produced in a cast iron grinding operation. The 3,000 gallons were treated with 0.9 gallons (approximately 300 ppm by volume) of the polyelectrolyte used in the above Examples. Rapid settling commenced within 5–10 minutes.

I claim:

1. A method of treating aqueous solutions of water-soluble lubricants containing suspended particles of water insoluble inorganics from the group consisting of metals, metallic oxides, silica and carbon which comprises the steps of:

A. adding at least 0.5 ppm by weight of a cationic polyelectrolyte to said water-soluble solutions;

B. dispersing said cationic polyelectrolyte and allowing the suspension to stand at least 2 minutes to allow flocculation and settling of said suspended particles to occur; and then, C. separating the water-soluble lubricant from the settled particles.

2. The method of claim 1 wherein the insoluble inorganic is silica and the amount of the cationic polyelectrolyte added in Step A is in the range of 8–250 ppm.

3. The method of claim 1 wherein the insoluble inorganic is a metal, metallic oxide or carbon and the amount of the cationic polyelectrolyte added in Step A is in the range of 0.5–1.8 ppm.

4. The method of claim 1 wherein the cationic polyelectrolyte is a quaternary ammonium polyamine formed by reaction of an alkylene dihalide, a water-soluble basic nitrogen compound from the group consisting of ammonia and the lower ethylene polyamines.

5. The method of claim 1 wherein the cationic polyelectrolyte is a quaternary ammonium polyamine formed by reaction of an alkylene dihalide, a water-soluble basic nitrogen compound from the group consisting of ammonia the the lower ethylene polyamine, and a lower alkyl halide quaternizing agent.

6. The method of claim 4 wherein the alkylene dihalide is chosen from the group consisting of ethylene dichloride and 1,2-propylene dichloride and the water-soluble basic nitrogen compound is chosen from the group consisting of ammonia, ethylene diamine, diethylene triamine, tetraethylene pentamine and triethyl pentamine.

7. The method of claim 3 wherein the alkylene dihalide is ethylene dichloride and the water-soluble basic nitrogen compound is ammonia.

8. The method of claim 5 wherein the alkylene dihalide is chosen from the group consisting of ethylene dichloride and 1,2-propylene dichloride, the water-soluble basic nitrogen compound is chosen from the group consisting of ammonia, ethylene diamine, diethylene triamine, tetraethylene pentamine and triethyl pentamine, and the quaternizing agent is chosen from the group consisting of methyl chloride, ethyl chloride and propyl chloride.

9. The method of claim 5 wherein the alkylene dihalide is ethylene dichloride, the water-soluble basic nitrogen compound and the quaternizing agent is methyl chloride.

10. The method of claim 1 wherein the cationic polyelectrolyte is an epihalohydrin-alkylene polyamine condensation copolymer.

11. The method of claim 10 wherein the epichlorohydrin is chosen from the group consisting of epichlorohydrin, epibromohydrin and epiiodohydrin, and the alkylene polyamine has the general formula:

$$H_2N(C_nH_{2n}NH)_xH$$

where $n$ is an integer from 1 to 4 and x is 1 or more.

12. The method of claim 11 wherein the epihalohydrin is epichlorohydrin and the alkylene polyamine is ethylene diamine.

13. The method of claim 1 wherein the cationic polyelectrolyte is a polyquaternary compound formed by the reaction of a secondary amine and a difunctional epoxy compound.

14. The method of claim 13 wherein the second amine is chosen from the group consisting of dimethylamine, ethylmethylamine, diethylamine, propylmethylamine, propylethylamine, dipropylethylamine, dipropylamine, dibutylamine, propylbutylamine, ethylbutylamine, methylbutylamine, pentylmethylamine, pentylethylamine and pentylpropylamine, and the difunctional epoxide is chosen from the group consisting of epichlorohydrin, epibromohydrin and epiiodohydrin.

* * * * *